United States Patent [19]

Zell et al.

[11] 4,260,209

[45] Apr. 7, 1981

[54] TRANSMISSION CABLE CONNECTOR

[75] Inventors: Dale R. Zell, Elizabethtown; Leroy J. Morningstar, Middletown, both of Pa.

[73] Assignee: AMP Incorporated, Harrisburg, Pa.

[21] Appl. No.: 939,756

[22] Filed: Sep. 5, 1978

[51] Int. Cl.[2] ..... H01R 3/06

[52] U.S. Cl. ..... 339/14 R; 29/842; 339/17 F; 339/22 B

[58] Field of Search ..... 339/14 R, 14 L, 17 F, 339/22 B; 29/628, 626

[56] References Cited

U.S. PATENT DOCUMENTS

| | | | |
|---|---|---|---|
| 4,083,615 | 4/1978 | Volinskie | 339/17 F |
| 4,094,564 | 6/1978 | Cacolici | 339/22 B X |

*Primary Examiner*—Roy Lake
*Assistant Examiner*—DeWalden W. Jones
*Attorney, Agent, or Firm*—Russell J. Egan

[57] ABSTRACT

An improved transmission cable connector is disclosed for providing mass termination of pre-stripped flat transmission cable having conductors on closely spaced centers with the connector providing selective programming of grounds within the connector. The connector includes three sub-assemblies, namely, a cover, a housing assembly with a plurality of receptacle type contacts and a ground bus mounted therein, and a strain relief member. The present connector employs slotted beams to effect a connection between the conductors and grounds of the cable and the terminals and bus bars of the connector. The cable is prepared in a cable stripper to cut the insulation and displace it towards the free end of the cable sufficiently to allow the conductors to be seated in the connector cover. The application tooling then inserts the exposed conductors into the proper alignment slots of the cover while simultaneously trimming them to the correct length. The housing and cover are then assembled to secure the cable in the connector and then the cable folded back upon itself over the cover and a strain relief applied to complete the assembly.

6 Claims, 14 Drawing Figures

Fig. 1
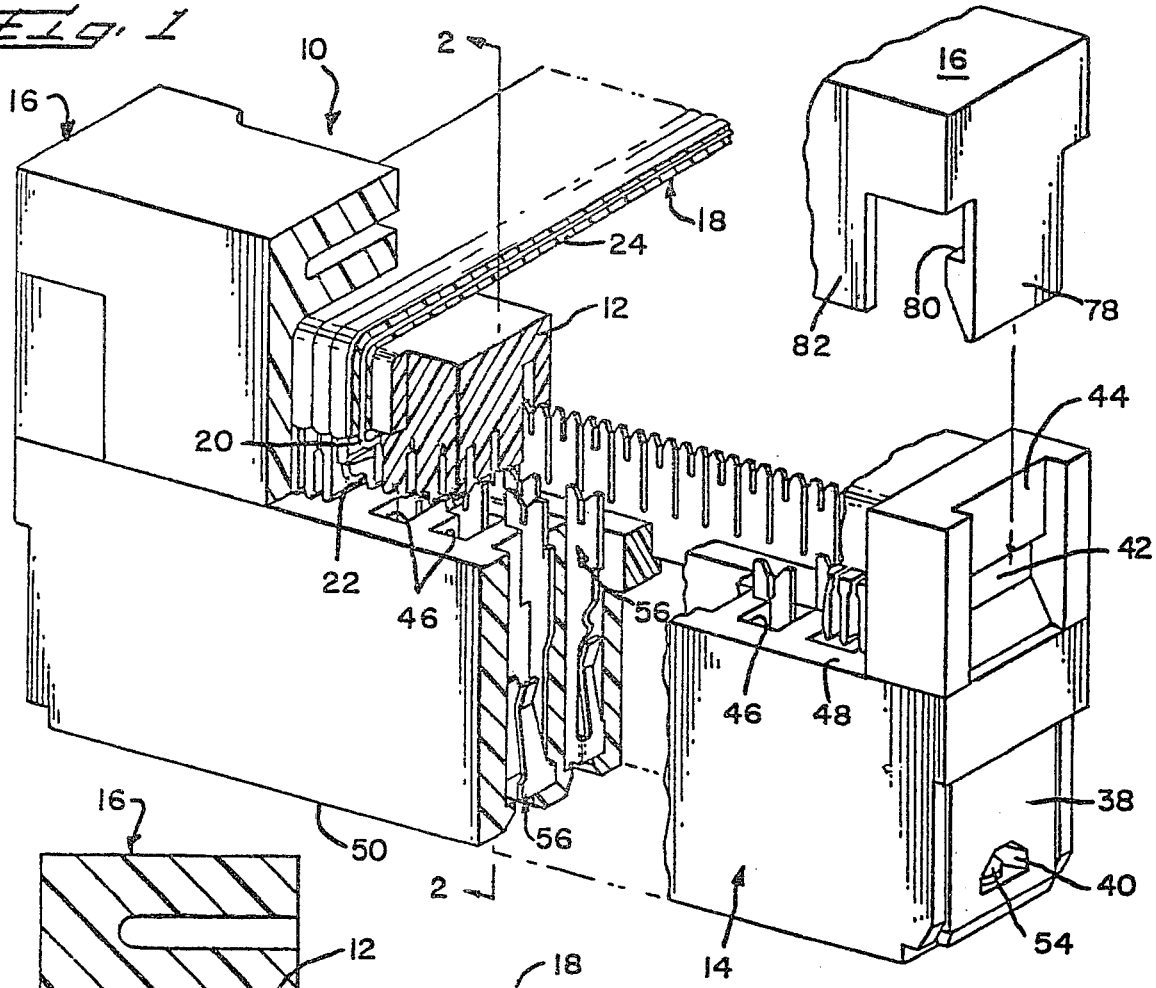
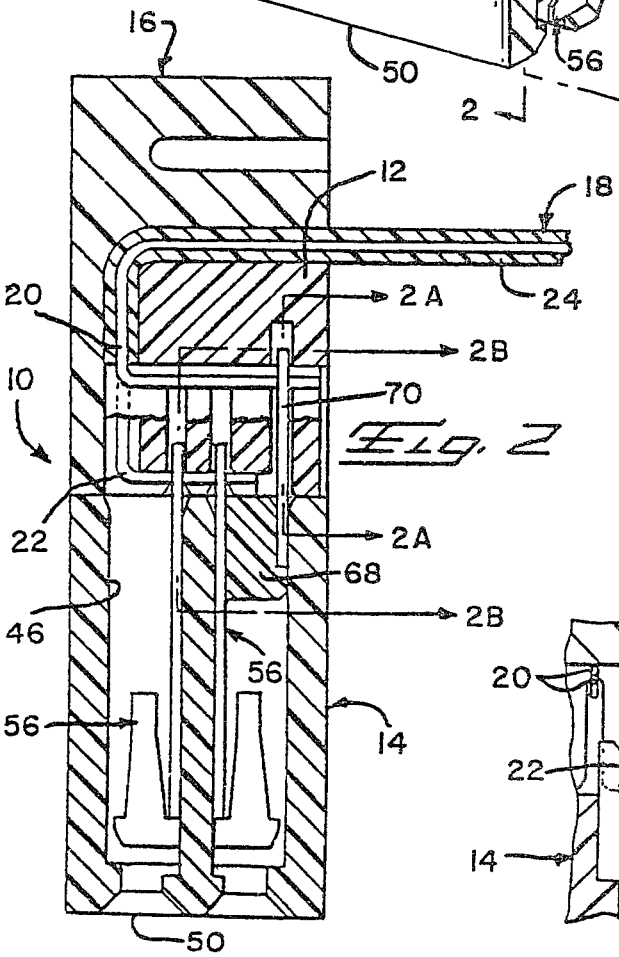
Fig. 2
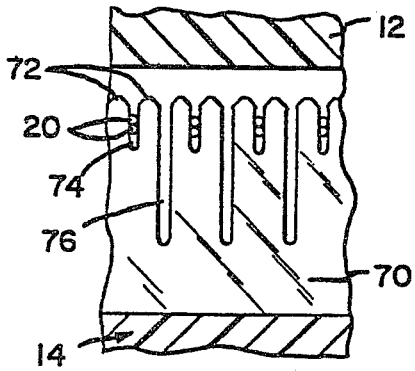
Fig. 2A
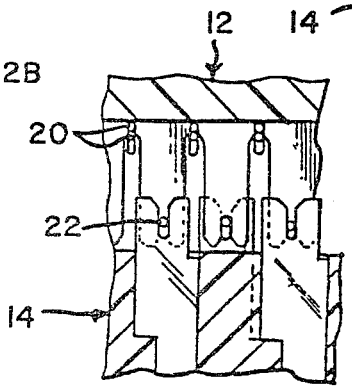
Fig. 2B

TRANSMISSION CABLE CONNECTOR

BACKGROUND OF THE INVENTION

1. The Field of the Invention

The present invention relates to a connector for terminating transmission cable having a plurality of conductors on closely spaced centers and in particular to a connector that employs solderless termination techniques.

2. The Prior Art

There have been many designs of flat high density high fidelity signal cable which have been developed and used in digital computer systems. However, the dependent relationships between cable geometry and electrical characteristics have prevented the development of standardized cable connectors. Due to the large number of different cable designs that have been developed, the most widely accepted method of effecting its termination has been the application of an interfacial device such as a printed circuit board between the cable end and the connector. This method adds cost and/or comprimises electrical performance or both.

Commoning of the ground leads in the connector eliminates the effect of the relationship between signal to ground spacing in electrical characteristics in the termination of the cable. The signal leads of the cable are ususally on 0.050 inch centers. This results in the elimination of an interfacial device and assures improved cable system performance.

SUMMARY OF THE INVENTION

The subject transmission cable connector is formed from three sub-assemblies, namely, a cover, a housing assembly with a plurality of receptacle contacts and a ground bus mounted therein, and a strain relief member. The cover is provided with a plurality of alignment slots to assure correct location and offset of the conductors for proper termination. Ground bars are installed in selected slots and provide interconnection between the ground bus and selected contacts in the housing when the cover is assembled on the housing. Lugs on each end of the cover provide guides and latching of the cover on the housing. The housing has a profile adapted to mate with known pin arrays of either the exposed and/or shrouded configurations. The connector is designed to mate with pins of either round or square sections. Each contact mounted in the housing has a pin engaging portion and a slotted beam portion for engaging a conductor of the cable. The ground bus mounts in a recess in the housing spaced parallel to the contacts and is slotted for terminating the ground conductors of the cable. The strain relief is designed to secure the cable to the cover in a folded over condition and to enclose the severed ends of the cable conductors.

It is therefore an object of the present invention to produce a transmission cable connector which eliminates the previous requirement for a paddle board interface thereby substantially reducing costs of termination of such cable.

It is a further object of the present invention to produce an improved transmission cable connector which can be used for effecting termination of such cable without utilizing soldering techniques.

It is a further object of the present invention to produce an improved transmission cable connector which can effect mass terminations of transmission line cable.

It is yet a further object of the present invention to produce an improved transmission cable connector which can be used for engaging rows of pin terminals having either round or square sections.

It is a further object of the present invention to produce an improved transmission cable connector which can be pre-programmed to select and position grounding terminals in the connector with appropriate bussing of all grounds to the selected terminals.

It is yet a further object of the present invention to produce an improved transmission cable connector which can be readily and economically produced.

The means for accomplishing the foregoing and other objects of the present invention will become apparent to those skilled in the art from the following detailed description taken with reference to the accompanying drawings.

BRIEF DESCRIPTION OF THE DRAWINGS

FIG. 1 is a perspective view of the subject connector partially broken away;

FIG. 2 is a vertical transverse section through the assembled subject connector taken along line 2—2 of FIG. 1;

FIG. 2A is a detail taken along line 2A—2A of FIG. 2 showing the connection of the ground bus to conductors of the cable;

FIG. 2B is a detail taken along line 2B—2B of FIG. 2 showing the detail of the engagement of the conductors and terminals of the present invention;

DETAILED DESCRIPTION OF THE PREFERRED EMBODIMENT

Figure 3:
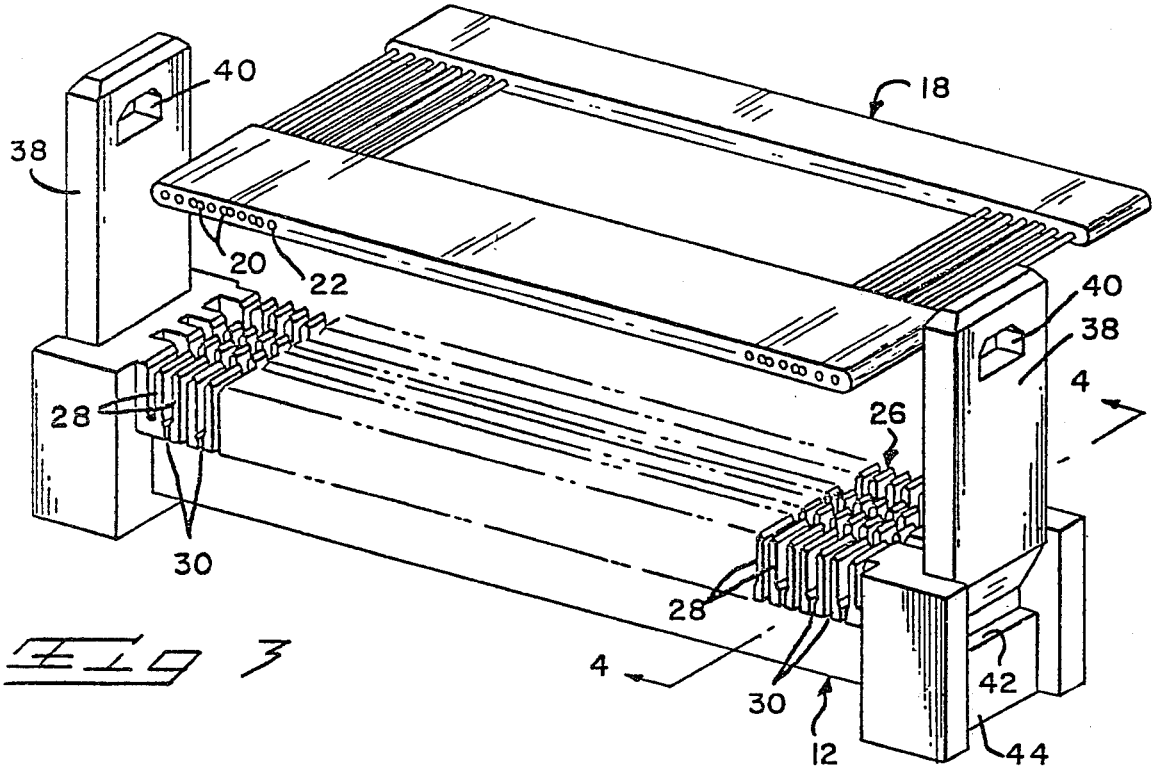
FIG. 3 is a perspective view of the cover of the present invention with a cable exploded above the cover.

The subject transmission cable connector 10 consists of three sub-assemblies, namely, a cover 12, a housing assembly 14, and a strain relief member 16. This connector is used to terminate a transmission cable 18 which has a plurality of ground conductors 20 and signal conductors 22 encased within insulation material 24 in parallel spaced relationship. Cables of this type are generally arranged with the conductors on closely spaced centers for example, .025 centers with the signal conductors having a ground on both sides thereof. Thus the arrangement of the conductors would be ground-signal-ground-ground-signal-ground, etc.

The cover 12 (FIG. 3) is an elongated member having a cable engaging face 26 which is formed with a plurality of upstanding tines 28 defining therebetween profiled conductor receiving passages, which are alternately ground passages 30 and conductor passages 32. The ground passages have a greater depth and are profiled at their inner end to form a constricted area 34. The tines 28 are also separated by transversely extending slots 36. Integral latching legs 38 extend from the cover at each end of the mating face 26. Each leg 38 has a profiled aperture 40 adjacent the free end thereof and a transverse groove 42 within a channel 44 at the opposite end of the leg.

Figure 9:
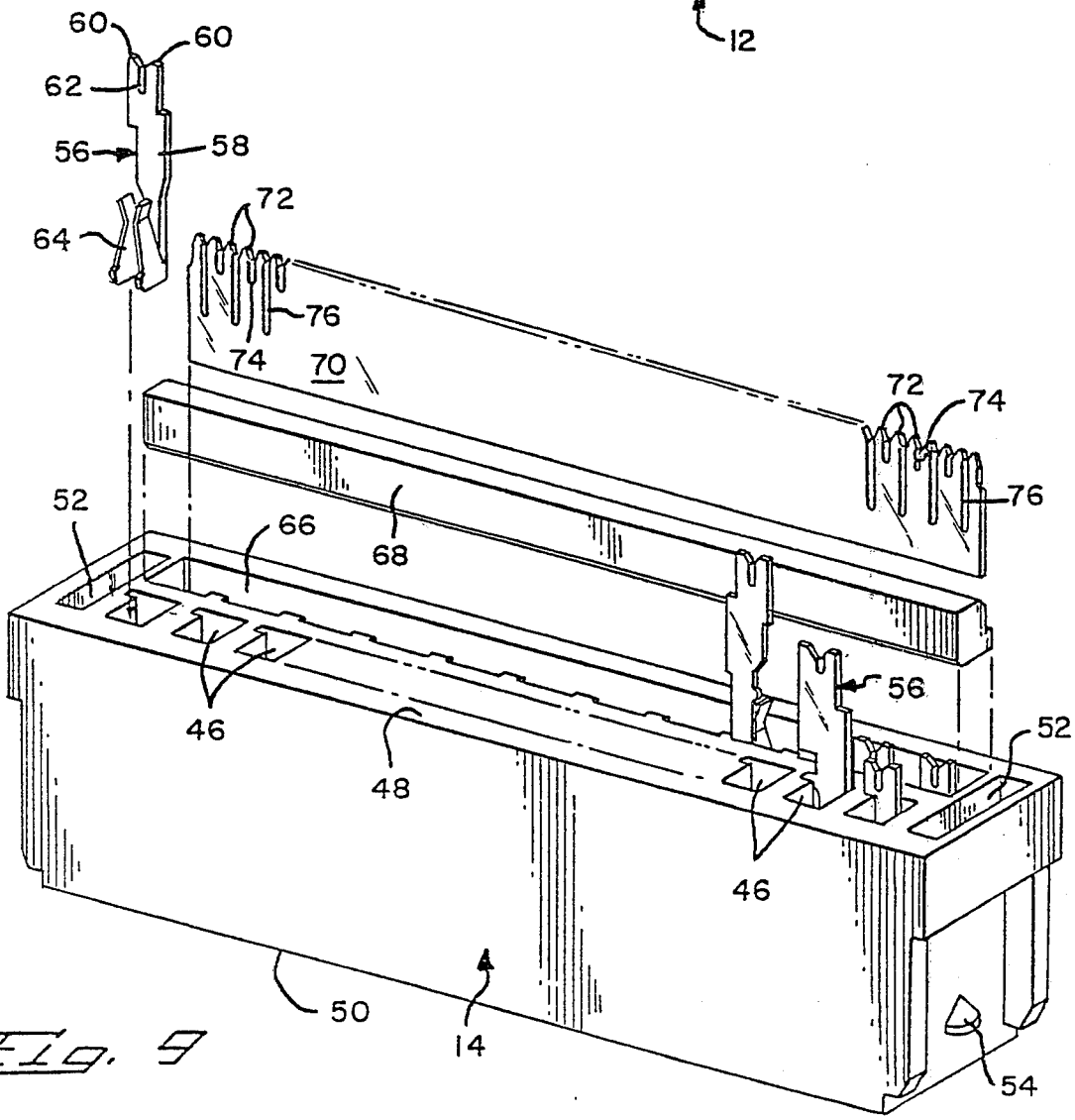
FIG. 9 is a perspective view of the connector housing with the terminals and bus bar exploded therefrom.
Figure 10:
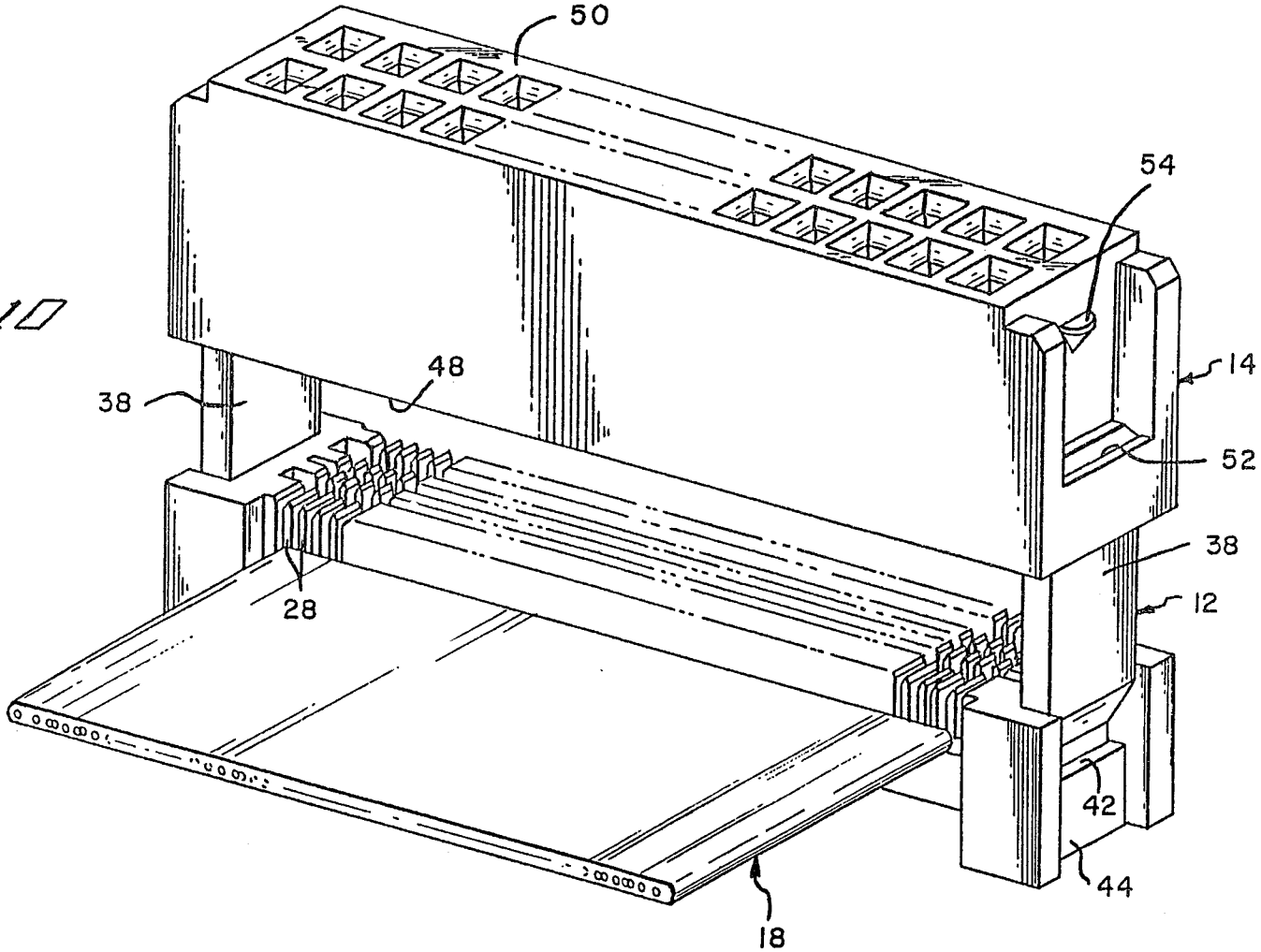
FIG. 10 shows the connector housing partially exploded above the cover having the cable fully inserted therein.

The housing 14 (FIG. 9) has a plurality of contact or receiving passages 46 extending therethrough from a cable engaging face 48 to a mating face 50. At each end of the elongated housing 14 there is a leg receiving passage 52 having a lug 54 sited therein. A contact terminal is 56 mounted in each respective passage 46. Each terminal has a body portion 58 with a pair of tines 60 extending from one end thereof, defining a wire engaging slot 62, and a mating portion 64 extending from the opposite end and defining a receptacle, here shown as a pair of spaced inwardly biased cantilever arms. An elongated recess 66 is formed in the cable receiving face 48 and receives therein an elongated profiled member 68 and a bus bar 70. The bus bar 70 has one elongated edge profiled to define a plurality of upstanding pairs of tines 72, with each pair of tines defining a slot 74 therebetween and each adjacent pair of tines being separated by a further slot 76.

The strain relief member 16 (FIG. 1) is an integral molded member having an elongated profile. On each end of the strain relief member there is a depending leg 78 with an inwardly directed lug 80 on the free end thereof. The strain relief also includes a shielding shroud 82 depending from one elongated side of the strain relief member.

Figure 4:
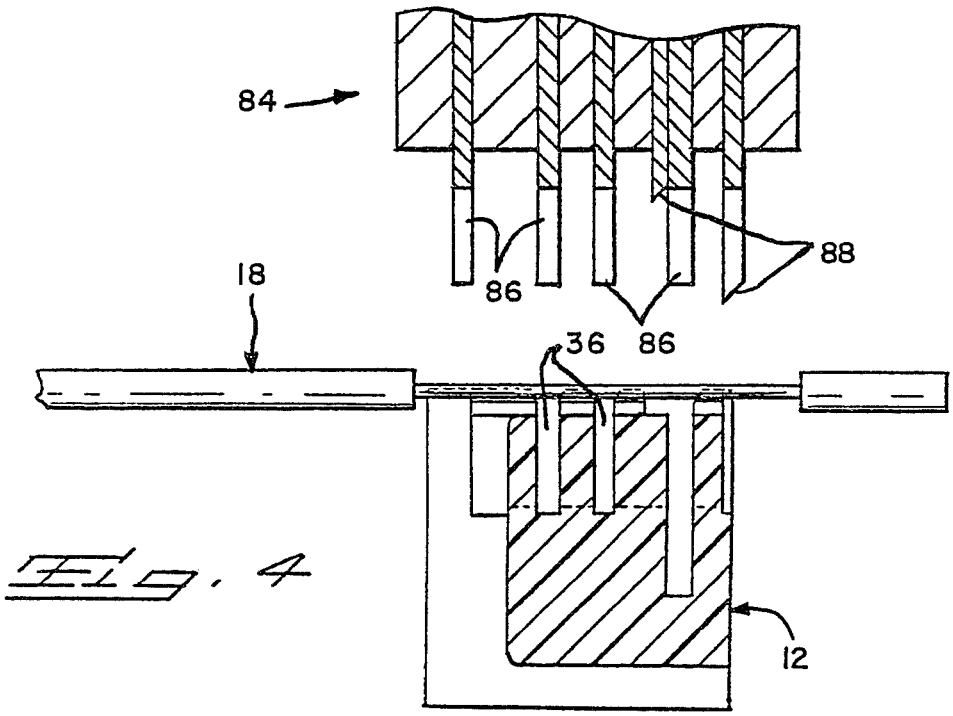
FIG. 4 is a vertical transverse section taken along line 4—4 showing the cover, cable, and a portion of a tool for inserting the cable into the cover.
Figure 5:
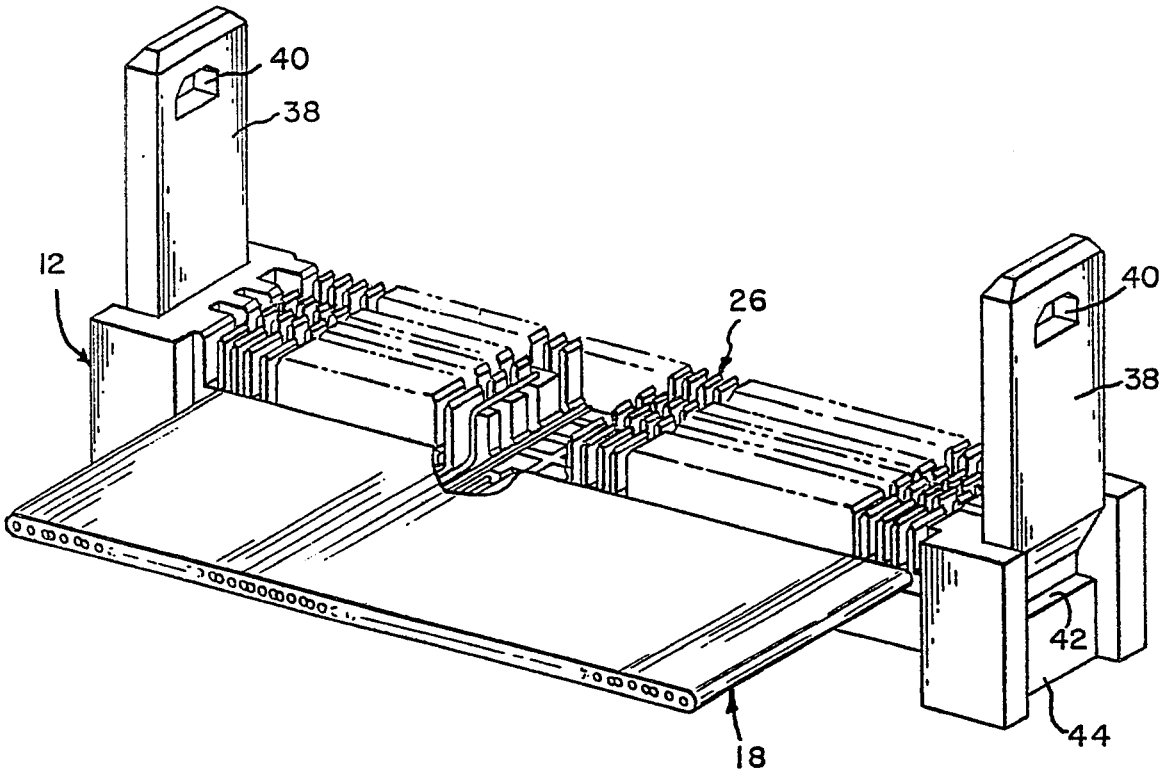
FIG. 5 is a view similar to FIG. 3 showing the cable fully inserted into the cover.
Figure 6:
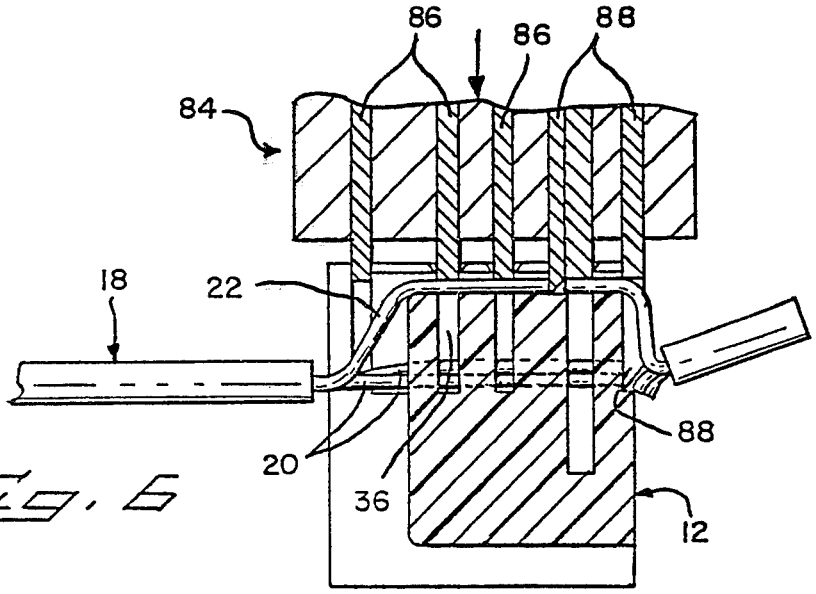
FIG. 6 is a view similar to FIG. 4 showing the cable as it is inserted into the cover.
Figure 7:
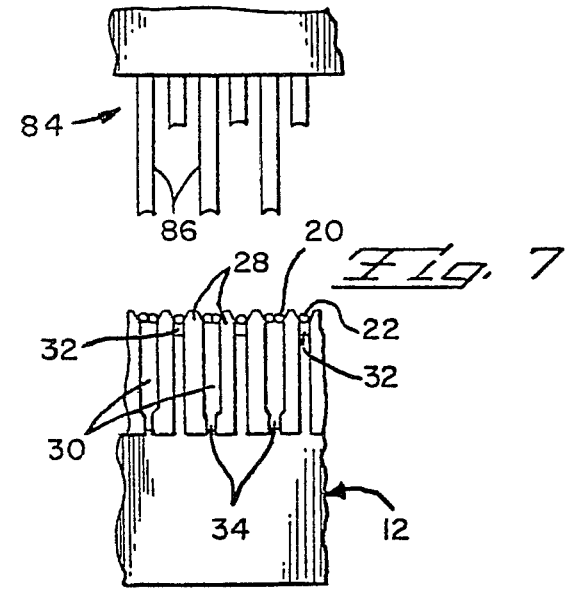
FIG. 7 is a lateral view of the connector and assembly apparatus as shown in FIG. 4.
Figure 8:
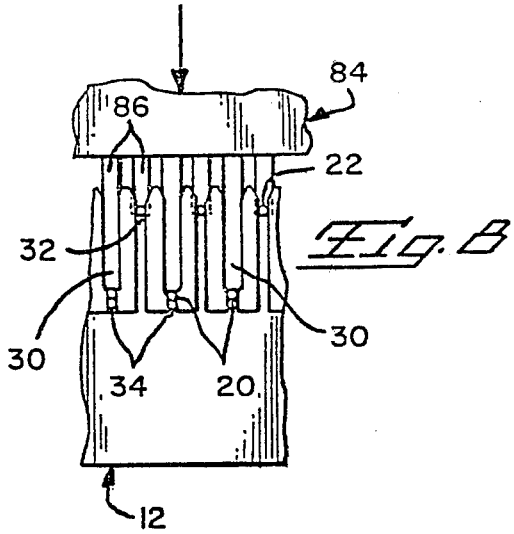
FIG. 8 is a lateral view showing the assembly of FIG. 6.

The use of the subject connector to terminate a transmission cable will now be described with reference to FIGS. 3 to 8. The cover member 12 is positioned with the cable engaging face 26 in an upward accessible condition. The cable 18 is trimmed and the insulation cut and moved towards the trimmed end of the cable to expose the ground and signal conductors, as shown in FIG. 3. The conductors of the cable are aligned with the respective ground and conductors passages, as shown in FIG. 5, and tooling 84 is used to force the conductors into their respective passages by stuffers 86, as shown in FIGS. 4 and 6. It should be noted that the conductors will assume two different elevations in the cover with the signal conductors 22 having the upper elevation, in other words lying near to the face 26, while the ground conductors 20 are forced more deeply into the cover. Simultaneously with the stuffing, the conductors are cut by the blades 86 of the assembly machine, as shown in FIG. 6, thereby leaving the cable in a fully inserted condition, as shown in FIG. 5. FIGS. 7 and 8 show the relative movement of the conductors into the passages of the cover. It should be noted that the profiled deep portion 34 of the ground passage 30 causes the pairs of ground conductors 20 to be stacked upon one another.

The connector housing 14, loaded with terminals 56 and bus bar 70, is inverted over the cover 12 so that the legs 38 of the cover are received in the passages 52. The housing is then driven onto the cover simultaneously causing the latching of the legs and the engagement of the conductors in the respective slots of the respective terminals for the signal conductors and the slots of the bus bar for the ground conductors. The cable is then folded around the cover, as shown in FIG. 1 and 2, and the strain relief member applied thereto with the lugs 80 of the strain relief member engaging in the grooves 42 of the cover member.

Figure 11:
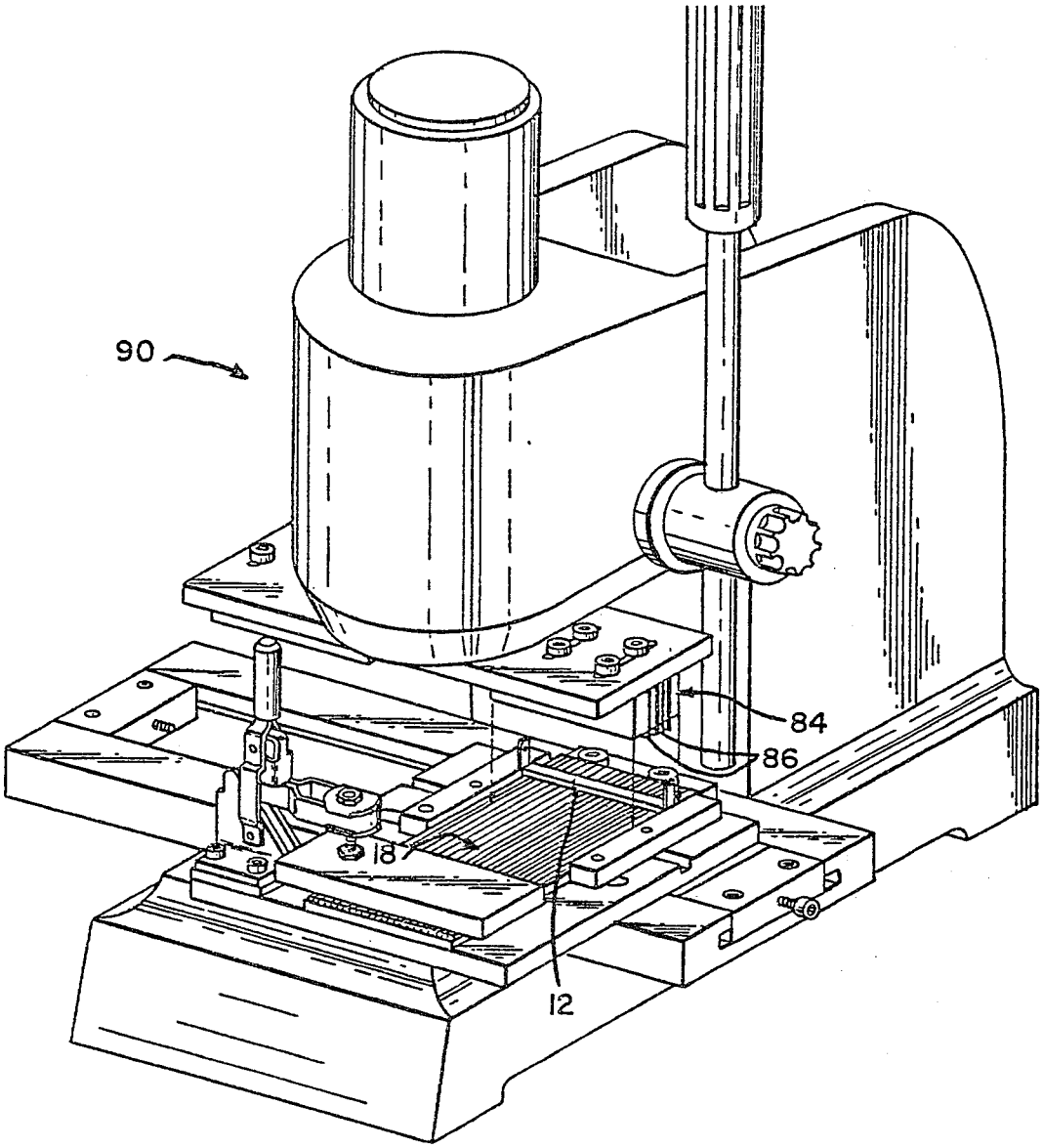
FIG. 11 is a perspective view of the assembly press with a cover positioned therein to receive a cable.
Figure 12:
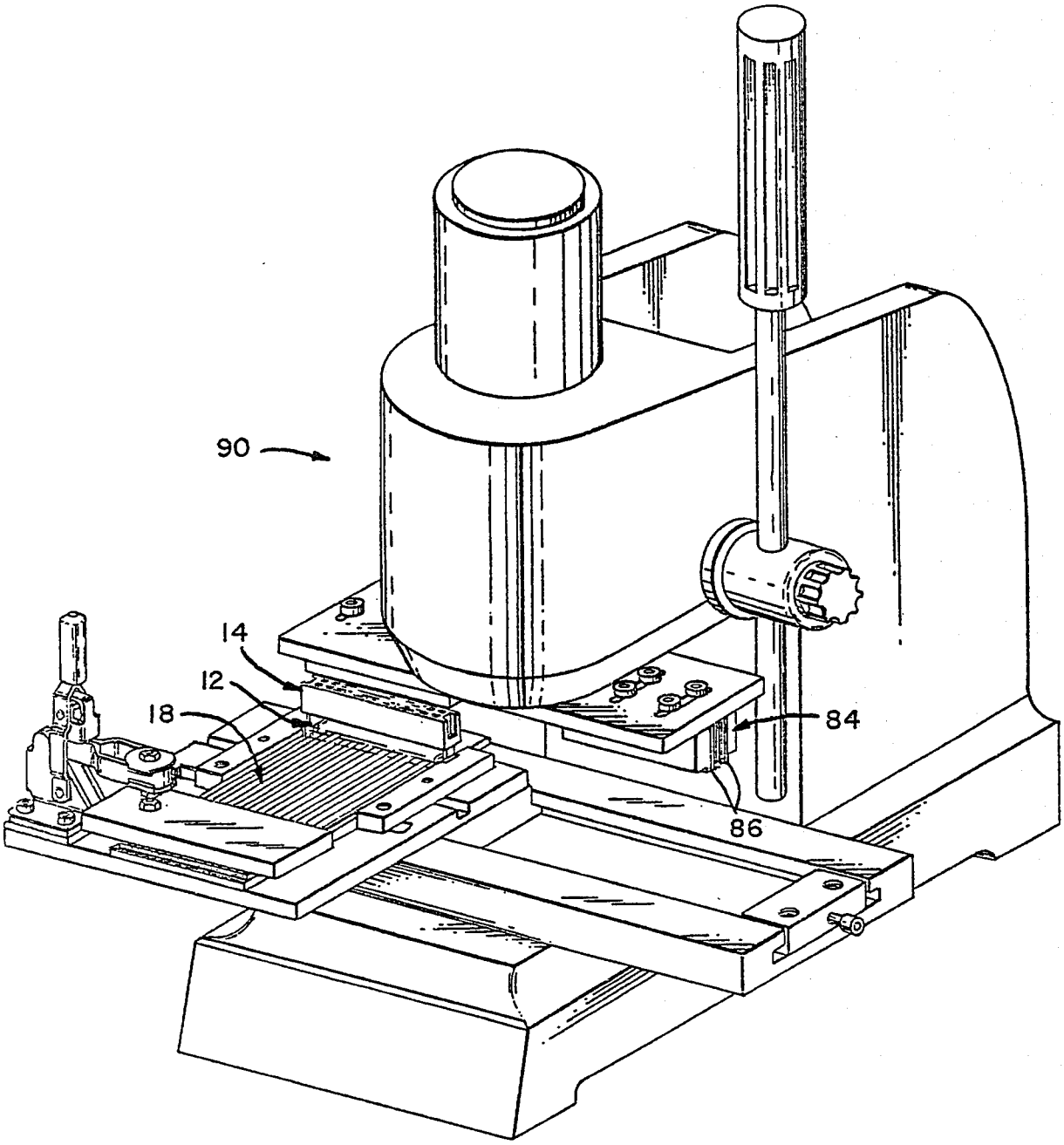
FIG. 12 is a perspective view of the press of FIG. 11 showing the connector housing positioned to be inserted to be joined with the cover.

The application tooling is shown in FIGS. 11 and 12 and is a bench press of fairly conventional design. The right-hand portion of the press head 90 carries the profiled tooling 84, including stuffers 86 and cutters 88 shown in end view in FIGS. 4 and 6. The left-hand portion of the head is profiled to drive the connector housing 14 against the loaded cover 12. Not shown in this embodiment would be a clamping means to hold the assembly of the cover 12 and housing 14 while the strain relief member 16 is being applied.

The present invention may be subject to many modifications and changes without departing from the spirit or essential characteristics thereof. The present embodiment should therefore be considered in all respects as illustrative and not restrictive of the scope of the invention.

What is claimed is:

1. An electrical connector for terminating flat transmission cable of the type having at least one ground conductor between adjacent signal conductors, all said conductors being secured in fixed, parallel, closely spaced relationship within an insulating web, said connector comprising:

a housing member having a plurality of through passages extending between a cable engaging surface and a mating face, a like plurality of terminals each received in a respective passage of said housing member with a mating portion directed towards said mating face and a conductor engaging portion formed by a pair of tines defining a signal conductor engaging slot therebetween extending from said cable engaging surface;

a bussing bar mounted in said housing with an elongated conductor engaging edge of said bar exposed from said cable supporting surface, said elongated edge of said bus bar defining a plurality of pairs of tines, each said pair of tines defining therebetween a ground conductor engaging slot;

a cover member having a cable engaging surface defined by a plurality conductor alignment channels, alternate ones of said channels being adapted to receive said signal conductors and said ground conductors respectively, and align them (signal and ground) with the appropriate slots of said terminals and said bussing bar, whereby conductors seated in said channels are terminated by applying said housing member to said cover member with said terminals and said buss bar effecting termination of the respective signal and ground conductors.

2. An electrical connector according to claim 1 further comprising:

means to latchingly secure said cover member to said housing member.

3. An electrical connector according to claim 1 further comprising:

strain relief means having means to latchingly engage said cover member holding said cable therebetween.

4. An electrical connector according to claim 1 wherein said housing member further comprises:

a transverse groove parallel to and spaced from said passages, said buss bar being mounted in said groove.

5. An electrical connector according to claim 1 wherein said conductor alignment channels extend transversely across said cover member with said channels adapted to receive ground conductors having a greater depth than the other channels.

6. An electrical connector for terminating flat, multiconductor transmission cable of the type having pairs of ground conductors separating adjacent signal conductors, all said conductors being secured in fixed, parallel, closely spaced relationship within an insulating web, said connector comprising:

a connector housing having a plurality of through passages extending between a cable engaging surface and a mating face, a transverse groove in said cable engaging surface, and latching means at opposite ends of said housing;

a plurality of terminals each received in a respective passage of said housing and having a mating portion directed towards said mating face and a conductor engaging portion extending from said cable engaging surface, said conductor engaging portion of each said terminal comprising a pair of tines defining a conductor engaging slot therebetween;

a bussing bar received in said transverse groove of said housing and having an elongated edge thereof exposed from said cable engaging surface, said elongated edge being profiled to define a plurality of parallel spaced pairs of tines, each pair of tines defining a slot adapted to receive therein at least one ground conductor;

a cover member having a surface defined by a plurality of pairs or ribs, each pair of ribs defining therebetween a passage extending transversely across a cable engaging surface of said cover, said passages being adapted to alternately receive said signal conductors and said ground conductors, respectively, and align them (signal and ground) with the appropriate slots of said terminals and said bussing bar, and latching means at opposite ends of said cover means for engaging the latching means of said housing; and strain relief means adapted to engage said cover to hold said cable thereagainst.

* * * * *